United States Patent [19]

Ishikura

[11] Patent Number: 4,889,468

[45] Date of Patent: Dec. 26, 1989

[54] SUBMERGED TYPE PUMP

[75] Inventor: Kazuo Ishikura, Tokyo, Japan

[73] Assignee: Nikkiso Co., Ltd., Tokyo, Japan

[21] Appl. No.: 291,451

[22] Filed: Dec. 27, 1988

[30] Foreign Application Priority Data

Dec. 28, 1987 [JP] Japan ..... 62-330138

[51] Int. Cl.[4] ..... F04D 27/00

[52] U.S. Cl. ..... 415/146; 415/24; 415/901; 417/358; 417/370

[58] Field of Search ..... 415/146, 26, 42, 46, 415/121.3, 24, 901; 417/358, 370

[56] References Cited

U.S. PATENT DOCUMENTS 2,082,996 6/1937 Wintroath ..... 415/146
2,802,423 8/1957 Gage ..... 417/358
3,652,186 3/1972 Carter ..... 417/370

*Primary Examiner*—Robert E. Garrett
*Assistant Examiner*—John T. Kwon
*Attorney, Agent, or Firm*—Young & Thompson

[57] ABSTRACT

There is disclosed a submerged type pump which is vertically seated on the seating face arranged on the bottom of the fluid lifting column and is comprised of a motor section and a pump section with a casing in which the treating fluid may pass, wherein a check valve is arranged at a pump discharge port and an automatic switch valve is arranged on the top of the casing so that the automatic switch valve is released by closing the fluid lifting column with the pump seating face and the check valve to discharge the treating fluid suspended in the fluid lifting column.

2 Claims, 3 Drawing Sheets

SUBMERGED TYPE PUMP

FIELD OF THE INVENTION

This invention relates to an improvement in a submerged type pump for use in the liquefied gas and more particularly to a submerged type pump for the liquefied gas capable of preventing back-flow of the treating fluid being suspended standstill in the top of the submerged type pump plugged in the handling fluid outpouring-use cylindrical conduit inserted into the liquefied gas storage tank, and which is equipped with an automatic switch valve capable of providing an exhaustion whenever necessary.

BACKGROUND OF THE INVENTION

Hitherto, various kinds of submerged type pumps are known as a pump used to exhaust liquefied gas contained in the storage tank. An example of the known pumps is explained by an overall concept diagram as shown in FIG. 3. First of all, to suck up a combustible liquefied gas from the storage tank 10, a fluid lifting column (hereinafter merely referred to as the column) 12 is vertically drawn down from the top of the storage tank 10 into the storage tank fluid and, furthermore, a submerged type pump 14 is suspended by a wire 18 through a winch 16 and set on the bottom inside the column 12.

When the submerged type pump 14 immersed in the storage tank fluid is activated, the treating fluid is delivered in the direction shown by an arrow of the solid line illustrated in the explanatory drawing of the delivery fluid of the conventional submerged type pumps as shown in FIG. 4. Namely, the handling fluid sucked through a suction port 22 of a pump section 20 is discharged through a discharge port 24 arranged on the boundary outer periphery between a motor section 26 and the pump section 20 and delivered to an exterior of the storage tank 10 while the column 12 is filled with the liquid. Further, when an operation of the pump section 20 is stopped, the residual fluid in the top of the submerged type pump 14 in the column 12 flows back in the direction of an arrow of the dotted line through the discharge port 24 and in turn is exhausted through the pump suction port 22 of the pump for gradual dipping and the dipping of the fluid is ceased for stabilization when reached at the same level as the fluid level in the storage tank 10.

Meanwhile, for the purpose of repair, inspection and the like, the submerged type pump is lifted up by the winder 16 such as the winch, hoist and the like through the wire 18 and after completion of repair or inspection, the pump is again descended to the bottom of the column for settlement of the seating face on the bottom of the column.

However, in case of restarting and operating such a pump as hereinbefore described, a desired discharge pressure may not be obtained before an inside of the column is filled with the fluid, and even a simple stop of the pump causes the fluid in the column to flow back to the storage tank resulting in drop of the fluid level so that the pump can not be started instantly, for which reason preparation of the fluid delivery by the pump requires much time with insufficient fluid delivery. Furthermore, in case a swing operation takes place by arranging a spare pump on one storage tank, it is still impossible to store the fluid in the column equipped with the spare pump, resulting in an intermittent operation of the pump with the problems of higher cost for fluid delivery and difficult operation.

Hence, the purpose of the invention is to provide a submerged type pump for liquefied gas, not only capable of preventing back-flow of the handling fluid remained on the top of the pump in the column but also capable of properly exhausting the fluid as desired allowing a consecutive operation with an efficient fluid delivery.

To accomplish the aforementioned purpose, there is provided a submerged type pump which is vertically seated on the seating face arranged on the bottom of the fluid lifting column and is comprised of a motor section and a pump section with a casing in which the handling fluid may pass, characterized in that a check valve is arranged at a pump discharged port and an automatic switch valve is arranged on the top of the casing so that the automatic switch valve is released by closing the fluid lifting column with the pump seating face and the check valve to discharce the handling fluid suspended in the fluid lifting column.

Further, in the submerged type pump according to the invention, the seat is tapered to which the pump is seated to close the fluid lifting column.

SUMMARY OF THE INVENTION

In the submerged type pump according to the invention, the liquefied gas stored in the storage tank is sucked by an actuation of the submerged type pump through the suction port of the pump then discharged through the discharge port to fill the fluid lifting column for delivery to the exterior. Further, when an operation of the pump is stopped, the fluid remained in the column is kept in storage since the bottom of the fluid lifting column is closed by the bottom of the pump casing and the seating face and also the pump delivery is closed by the check valve. Accordingly, it allows an instant actuation of the pump immediately after the temporary stop of the pump allows a consecutive delivery of the fluid. Moreover, in case the pump is lifted up by a winch and the like for repair and inspection of the pump, the fluid remained in the top of the pump flows back through the motor section and the pump section by opening the automatic switch valve and discharged in the storage tank through the suction port. Thus, when the pump is lifted up, no load is applied to the wire except the self-weight of the submerged type pump with no substantial increase of the power and the cost.

BRIEF DESCRIPTION OF THE DRAWINGS

A typical embodiment of the submerged type pump for the liquefied gas according to the invention shall be described more in detail with reference to the accompanying drawings in which.

PREFERRED EMBODIMENTS OF THE INVENTION

Figure 3:
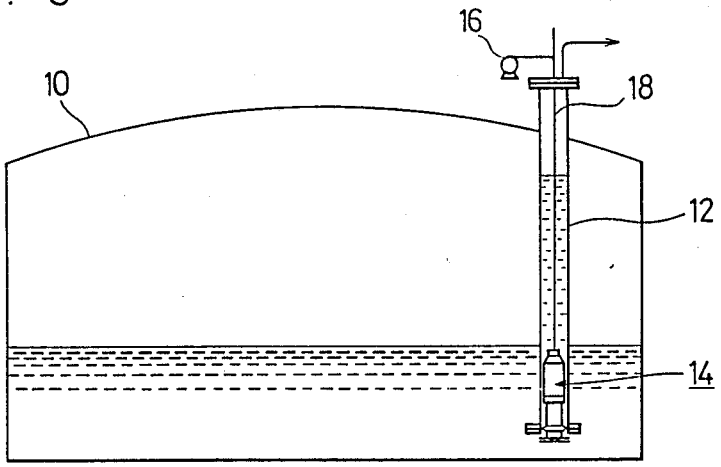
FIG. 3 is an overall pictorial view of the submerged type pump.
Figure 4:
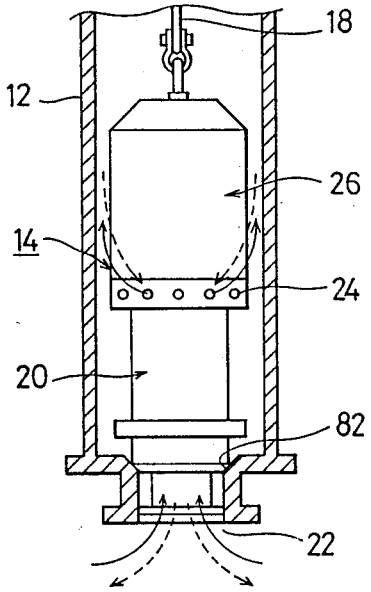
FIG. 4 is a pictorial view of the fluid delivery process by the conventional submerged type pump.

Meanwhile, for the sake of convenience in description, the same reference numeral is applied to the same part of the conventional structure as shown in FIGS. 3 and 4 so that the detailed description thereof has been omitted.

Figure 1:
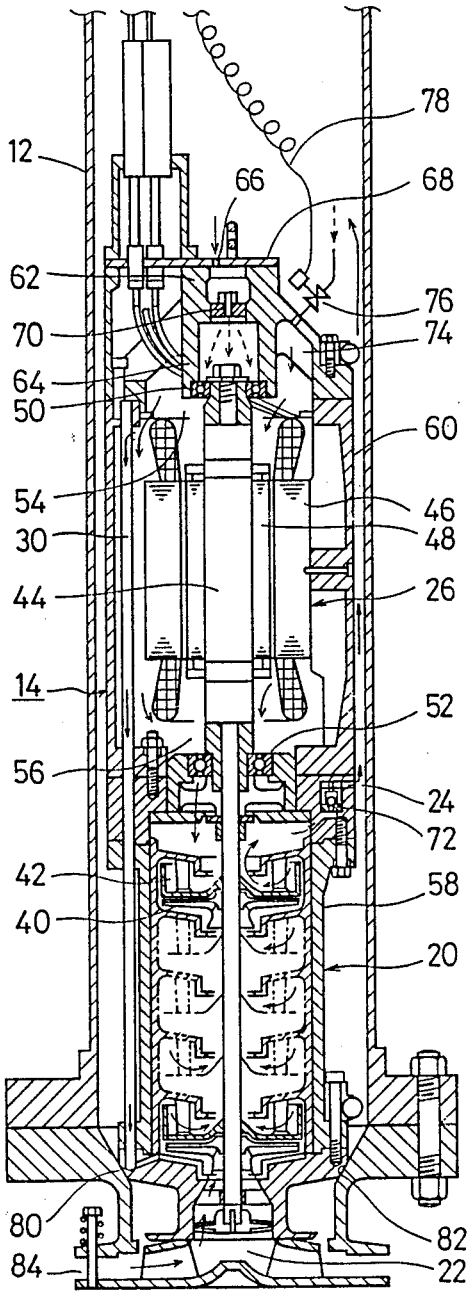
FIG. 1 is a fragnmentarily enlarged sectional view of the submerged type pump according to the invention.
Figure 2:
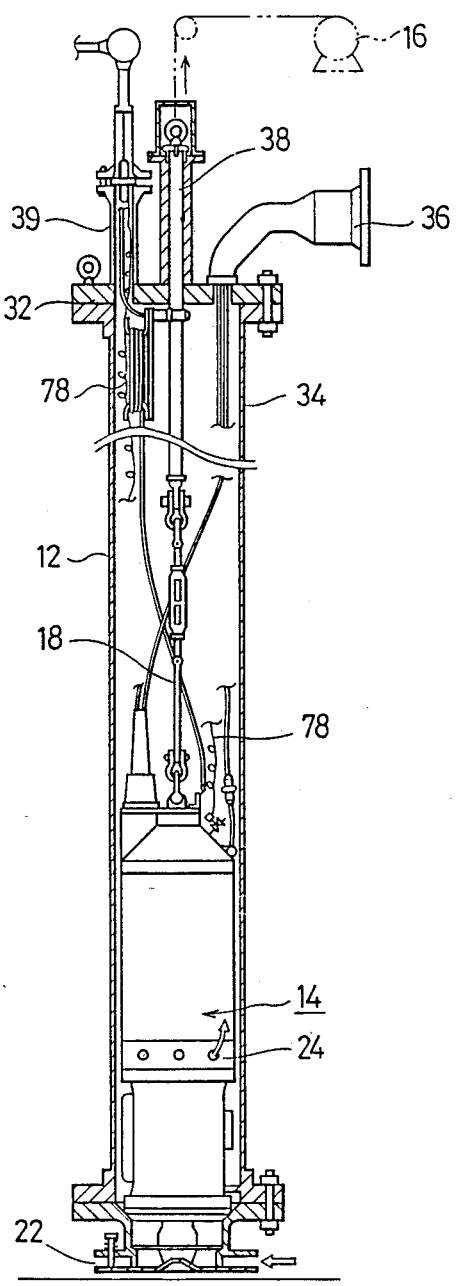
FIG. 2 is a sectional view of the submerged type pump arranged in the cylindrical conduit.

FIG. 1 represents a fragmentarily enlarged sectional view of the submerged type pump, while FIG. 2 represents a sectional view showing one embodiment where the submerged type pump is disposed in the column.

In FIG. 1, the submerged type pump 14 is comprised of a pump section 20 and a motor section 26. The pump section 20 arranged in the lower portion of the motor section 26 is equipped with a suction port 22 in communication with each pump chamber 42 having a number of impellers 40 (5 sets in this embodiment) and a plurality of the discharged ports 24, each of which is provided with a check valve 72 respectively. Furthermore, the impeller 40 is mounted on an elongated shaft section of the rotor shaft 44 of the motor section 26.

On the other hand, the motor section 26 is comprised of a stator assembly 46 and a rotor assembly 48 and a rotor shaft 44 is supported respectively by a top bearing 50 and a bottom bearing 52. A rotor assembly 48 at its upper and lower ends is provided with a top rotor chamber 54 and a bottom rotor chamber 56 respectively. Further, the pump section 20 and the motor section 26 are respectively housed in a casing including a pump casing 58 and a motor housing 60. The motor housing 60 at its top is hindered with an end bell 62 within which a top bearing housing 64 is arranged to support the top bearing 50. The end bell 62 at its top is provided with a cover plate 68 having a partial aperture 66 and an orifice 70 is arranged in the top bearing housing 64 to introduce a part of the handling treating fluid from the aperture 66 into the top bearing 50.

Moreover, in the end bell 62 is formed an upper fluid chamber 74 which is communicated with the top rotor chamber 54. In the upper fluid chamber 74, there is provided an electromagnetic valve of an automatic switch valve for inducing an external treating fluid or an automatic switch valve 76 capable of providing a remote control operation of an inert gas such as nitrogen and the like from an exterior. An external operation of the valve 76 may be carried out through a cable 78. Further, on an external side wall of the submerged type pump 14, a return tube 30 is arranged in communication with the upper rotor chamber 54 of the motor section 26 and the lowest column impeller chamber of the pump section 20.

When the submerged type pump thus constructed is disposed on the bottom of the column 12, an outer edge corner section 80 formed on the bottom of the pump casing 58 is joined with a seating face 82 of the taper formed in the bottom of the column 12 to provide a closed state from the exterior.

On the other hand, the column 12 at its top is mounted with a head plate 32 which is provided with a terminal tube 35 engaging with a terminal box (not illustrated) for containing a cable 34 of the motor section 26 as shown in FIG. 2. Furthermore, from the center of the head plate 32 a lift bar 38 linked with the wire 18 for suspending the submerged type pump is projected and this lift bar 38 is supported by a spacer vertically installed in the head plate 32. While, the cable 78 of the automatic switch valve 76 is so configurated that it may be withdrawn to the exterior through the guide tube 39 vertically installed with the head plate 32.

The submerged type pump configurated as described hereinbefore will operate as follows.

In FIG. 1, when an operation of the motor section 26 is commenced, an impeller 40 of the multi-row type pump section 20 is rotated and the liquefied gas stored in the storage tank 10 as the handling fluid is sucked from the foot valve 84 on the bottom of the column 12 through the suction port 22 of the pump into the pump chamber 42. The handling fluid sucked is further compressed in the pump chamber 42 and then delivered through the discharge port 24 to the exterior in the highly pressurized state after the check valve 72 is released. The handling fluid discharged is then delivered along with an arrow-mark as shown in FIG. 1 to fill the column 12 and then delivered to the exterior of the storage tank 10. When an operation of the submerged type pump 14 is stopped to interrupt the delivery of fluid, the handling fluid filled in the column 12 is stored by closing the check valve 72, the seating face 82 and the outer edge corner section 80 of the pump casing 58. However, a minor part of the handling fluid stored in the column 12 is flown out through the aperture 66 of the cover plate 68 and delivered to the upper bearing 50 through the orifice 70 to lubricate the bearing. The handling fluid passing through the upper bearing 50 is further passed from the upper rotor chamber 54 through between the rotor 48 and the stator 46 and the exterior of the tester 46 for the lower rotor chamber 56. Furthermore, the handling fluid passed through the lower rotor chamber 56 is directed through the lower bearing 52 into the multi-row pump chamber 42 and is then discharged from the pump suction port 22 through foot valve 84 to the exterior.

Since, however, the volume of the handling fluid flowing through the submerged type pump for lubrication of the bearing is minor, much time is required to exhaust the fluid stored in the column 12 when the pump is lifted up for repair and inspection, for which reason even the fluid is pressurized with nitrogen gas from the exterior to shorten the efflux time the problem still remains with no substantial reduction of the time as expected.

Hence, according to the invention, an automatical release of the automatic switch valve 76 arranged on the end bell 62 on the top of the submerged type pump 14, which constitutes a part of the casing, allows a positive flow of the stored fluid remained in the column 12 through the same channel as used during lubrication of the bearing section for return to the storage tank 10 in a short period of time. Further, when the submerged type pump is lifted up by the winch 16 for inspection or repair, the head plate 32 as shown in FIG. 2 is released, the lift bar 38 together with the head plate 32 on which various kinds of cables are mounted are lifted up by the winch 16 so that the submerged type pump may conveniently be taken out to the exterior.

As hereinbefore fully described, the submerged type pump according to the invention is vertically seated on the seating face arranged on the bottom of the fluid lifting column and is comprised of a motor section and a pump section allowing the handling fluid to flow through the casing, wherein a check valve arranged at the discharge port of the pump allows delivery of the fluid by the consecutive operation of the pump without any likelifood of the stored fluid remained in the fluid lifting column to return to the storage tank even when the pump is stopped and also allows a consecutive delivery of the fluid as well by switching an operation when the spare pump is arranged with an improved operation efficiency and the cost reduction for the fluid delivery.

Moreover, an arrangement of an automatic switch valve on the top of the housing section of the submerged type pump allows return of the remaining fluid, when the pump is lifted up for repair or inspection, to the storage tank within a short period of time with power saving required for lifting the pump.

Suitable embodiment of the invention has been described to explain the invention, notwithstanding a variety of changes in design may be practicable within the scope of not deviating from the philosophy and spirit of the invention.

What is claimed is:

1. A submerged type pump which is vertically seated on a seating face arranged on a bottom of a fluid lifting column and is comprised of a motor section and a pump section with a casing in which a handling fluid passes, characterized in that a check valve is arranged at a pump discharged port and an automatic switch valve is arranged on the top of a casing so that said automatic switch valve is released by closing said fluid lifting column with the pump seating face and the check valve to discharge the handling fluid suspended in said fluid lifting column.

2. A submerged type pump according to claim 1, wherein the seat is tapered to which the pump is seated to close the fluid lifting column.

* * * * *